US005772069A

United States Patent [19]

Price

[11] Patent Number: 5,772,069

[45] Date of Patent: Jun. 30, 1998

[54] CUP HOLDER

[76] Inventor: Bill M. Price, 1072 NE. Highway 52, Windsor, Mo. 65360

[21] Appl. No.: 696,261

[22] Filed: Aug. 13, 1996

[51] Int. Cl.[6] ..... B65D 25/00

[52] U.S. Cl. ..... 220/737; 220/738

[58] Field of Search ..... 220/737, 738, 220/740, 408

[56] References Cited

U.S. PATENT DOCUMENTS

| | | | |
|---|---|---|---|
| D. 303,194 | 9/1989 | Darby et al. | D7/3 |
| D. 314,314 | 2/1991 | Shipman | D7/616 |
| D. 316,205 | 4/1991 | Conrad | D7/305 |
| 378,361 | 2/1888 | Fox | 220/737 X |
| 1,389,594 | 3/1921 | Moore | 220/738 |
| 2,805,017 | 9/1957 | Hill, et al. | 220/737 |
| 3,262,626 | 7/1966 | Davis | 229/1.5 |
| 3,653,575 | 4/1972 | Schrepper | 229/1.5 H |
| 4,040,549 | 8/1977 | Sadler | 224/29 G |
| 4,323,172 | 4/1982 | Lim | 222/130 |
| 4,928,848 | 5/1990 | Ballway | 220/444 |

*Primary Examiner*—Steven M. Pollard
*Attorney, Agent, or Firm*—Chase & Yakimo

[57] ABSTRACT

A drinking cup system comprises a holder for releasably engaging a drinking cup therein. The holder presents a base formed by a plurality of horizontal ribs extending from a hub, each rib having a depending offset at the end thereof. A plurality of ribs vertically extend from each offset to form a holder sidewall. The cup includes a depending flange adapted to be releasably received within the channel and supported by at least the channel and the plurality of horizontal ribs. Alternatively, a conventional cup can be supported with the holder atop the horizontal ribs. The cup includes a releasably engageable lid.

3 Claims, 9 Drawing Sheets

CUP HOLDER

BACKGROUND OF THE INVENTION

This invention relates to a drinking cup system and, more particularly, to a drinking cup and holder combination, the holder releasably engaging a particularly designed cup as well as a conventional cup therein.

Various cup/holder combinations have been previously proposed as evidenced by the cited references. Such past holders have been usually designed for use with a particular cup. It is desired to have a cup which is positively releasably engageable with the holder. Also, if the cup is lost or misplaced, it is desirable to provide a holder which will either support the particularly designed cup or a conventional cup therein.

In response thereto I have invented a cup/holder combination, the holder having a base for engaging a depending flange of a cup as well as a support surface for supporting a conventional cup therein. The holder is generally cylindrical in configuration, the base of the holder presenting a plurality of horizontal ribs radially extending from a hub and towards the sidewall of the holder. Each rib includes a first horizontal portion in a first common plane to provide a first level support area. The ribs at the ends thereof are offset so as to present a depending channel for receiving a flange depending from the bottom of the cup therein. A mounting plate with an optional attachment plate allows the holder to be mounted to various surfaces.

It is therefore a general object of this invention to provide an improved cup/holder combination.

Another object of this invention is to provide a cup/holder, as aforesaid, which supports either a particularly designed cup or a conventional cup therein.

Another object of this invention is to provide a cup/holder, as aforesaid, the designed cup having a depending flange for engaging a channel formed at the bottom of the holder.

Another object of this invention is to provide a holder, as aforesaid, presenting a first support surface surrounded by a second depending channel, the channel engaging a flange depending from the cup.

Another particular object of this invention is to provide a mounting plate with optional attachment flange for mounting the holder to various surfaces.

A particular object of this invention is to provide a cup having a lid releasably engageable thereto.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Turning more particularly to the drawings, a drinking system 10 is shown as comprising a cup 100 nested within a cup holder 500.

Figure 1:
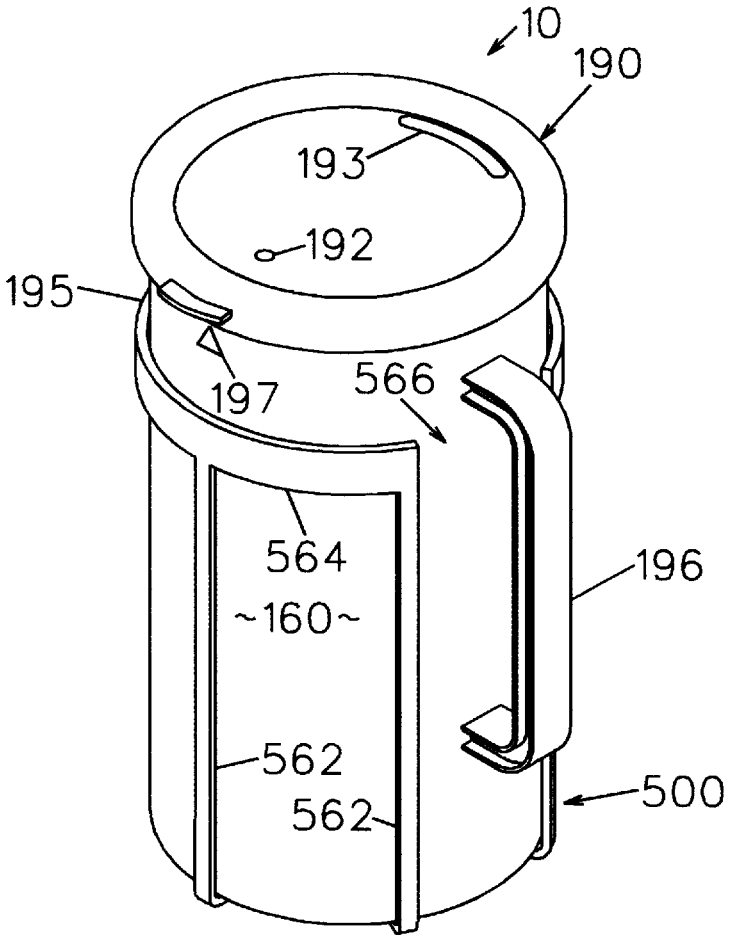
FIG. 1 is a perspective view of the holder with cup therein.
Figure 2:
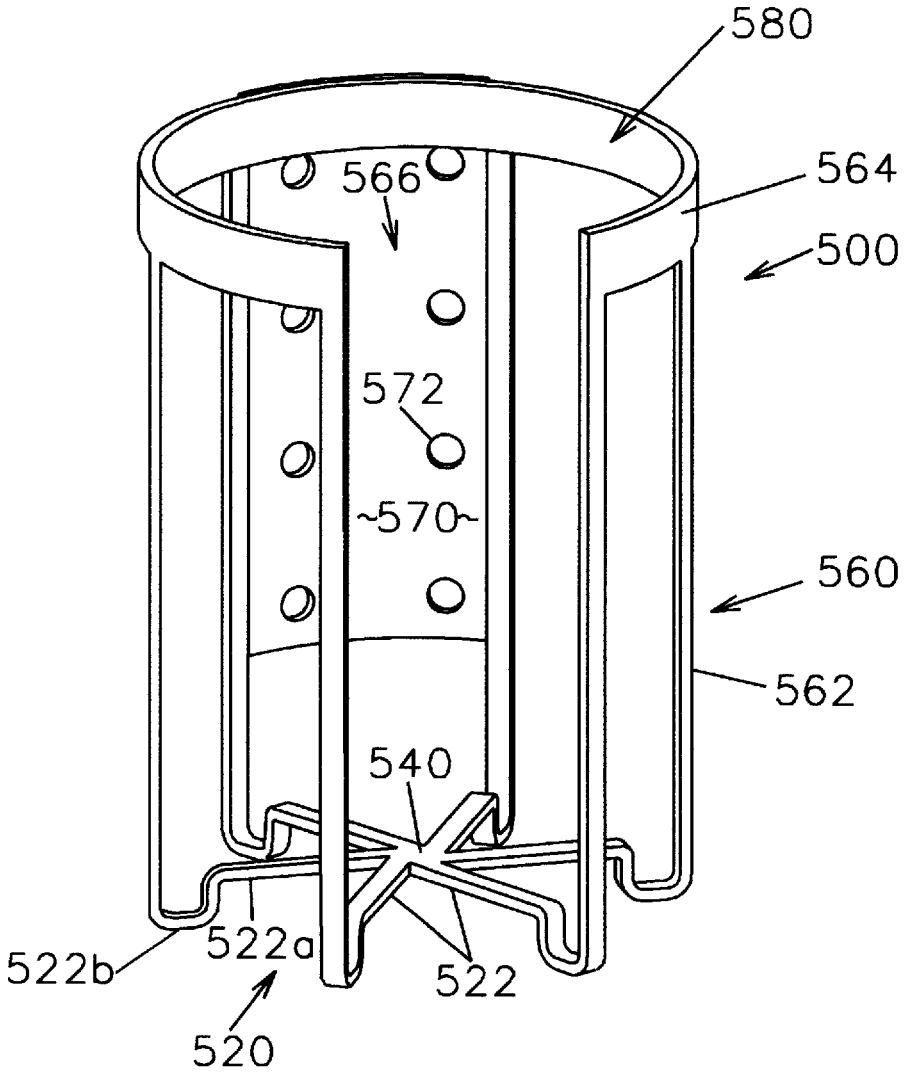
FIG. 2 is a perspective view, on an enlarged scale, of the holder.
Figure 3:
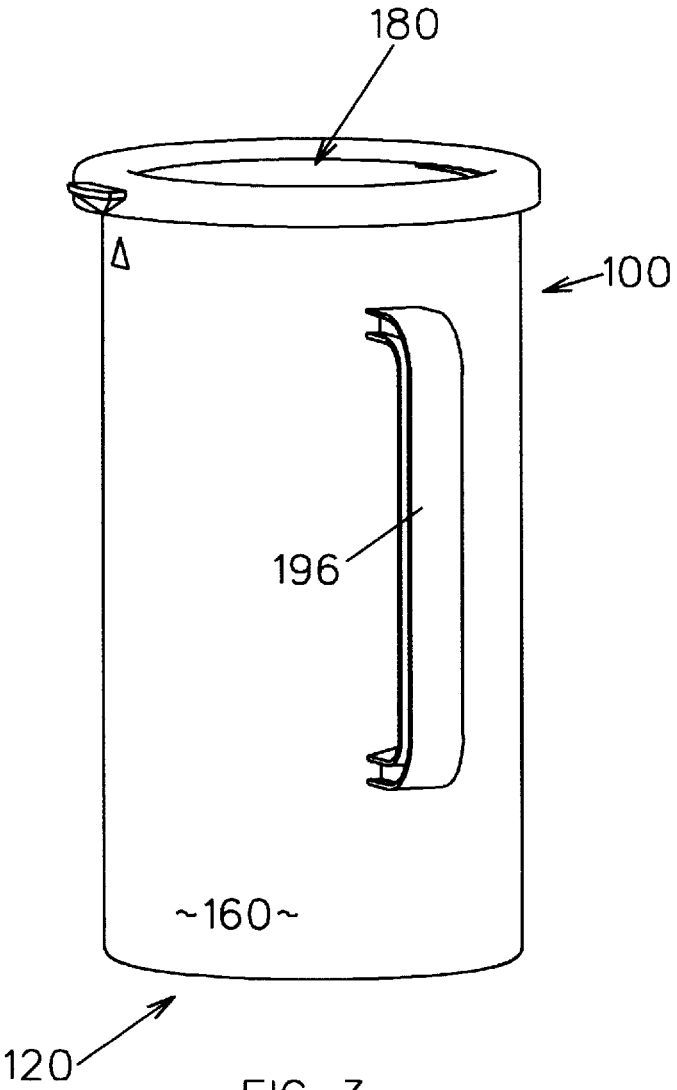
FIG. 3 is a perspective view of the cup on an enlarged scale.
Figure 4:
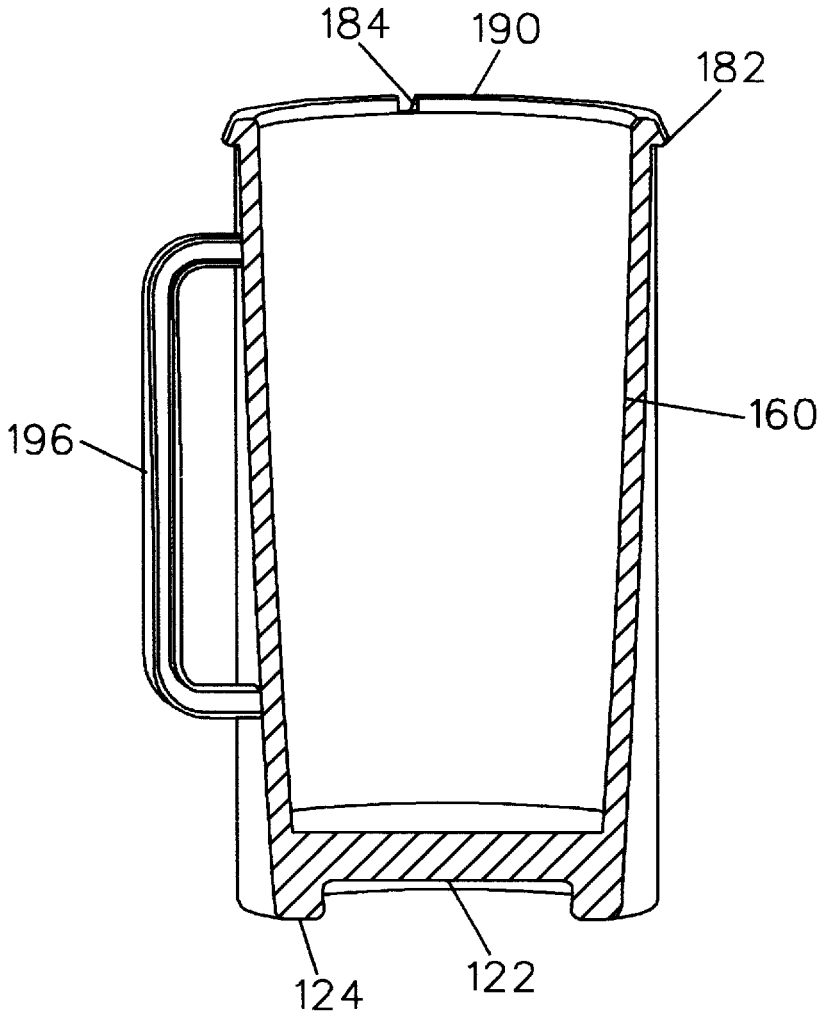
FIG. 4 is a central sectional view of the cup.
Figure 5:
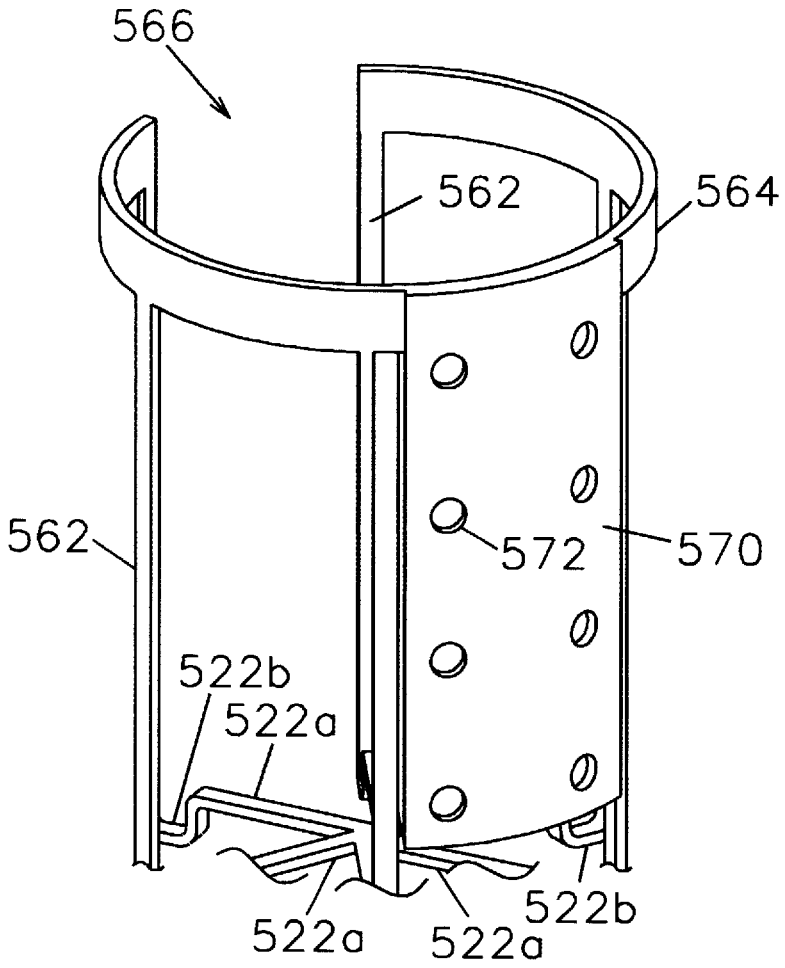
FIG. 5 is a partial fragmentary view of the cup holder, on an enlarged scale, showing the mounting plate.
Figure 6:
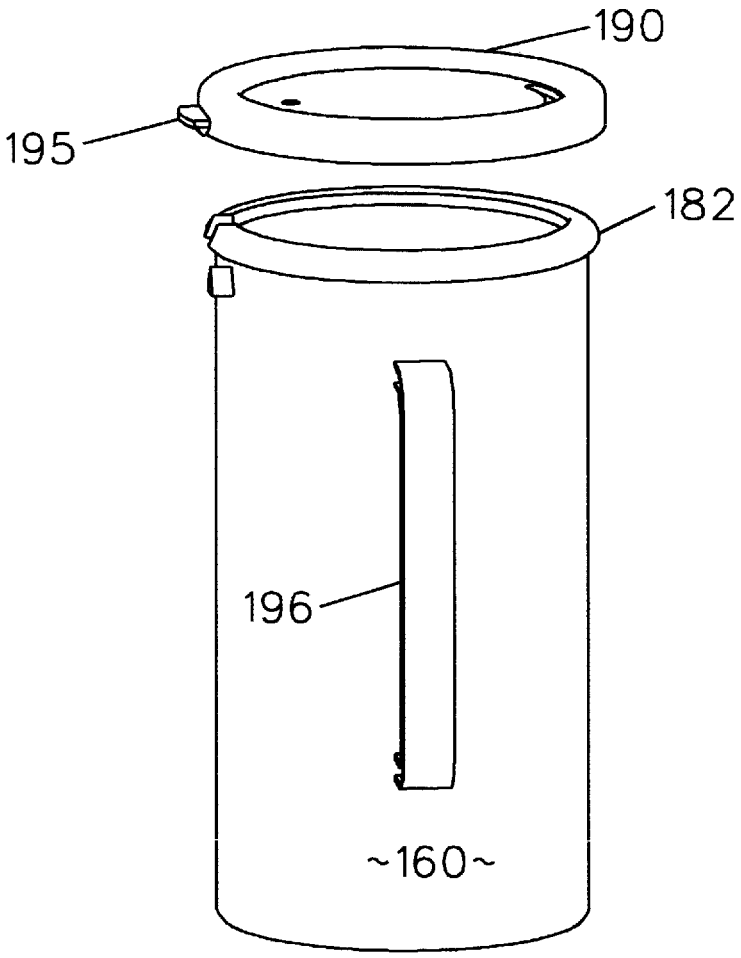
FIG. 6 is a view showing the lid exploded from the cup proper.

Holder 500 generally presents a cylindrical vessel having a base 520, sidewall 560 and opening 580 at the top end of sidewall 560. As shown in FIG. 2, the holder base 520 is presented by a plurality of ribs 522 radially extending from a central hub 540. Each rib comprises a generally horizontal portion 522*a* with a depending offset 522*b* at the end thereof. A vertical rib 562 upwardly extends from the offset end of each rib 522, a plurality of such ribs 562 presenting the vertical sidewall 560 of the holder 500. A band 564 connects the top of each rib 562. The extension of band 564 is interrupted at 566 to present an opening 566 allowing for a cup handle 196 to extend therethrough. The plurality of depending offsets 522*b* cooperate with the horizontal portion 522*a* of each rib 522 and the vertical ribs 562 forming the sidewall so as to present a depending channel which circumscribes the circumference of the holder at the bottom thereof.

The cup 100 includes a base 120, sidewall 160 with opening 180 and lid 190. The cup base 120 includes a first horizontal surface 122 surrounded by a depending flange 124, the flange 124 designed to releasably nest in the above-described channel of the cup holder 500. The diameter of the cup 100 is such that the cup sidewall 160 will be contiguously adjacent the ribs 562 forming the holder sidewall.

Figure 8:
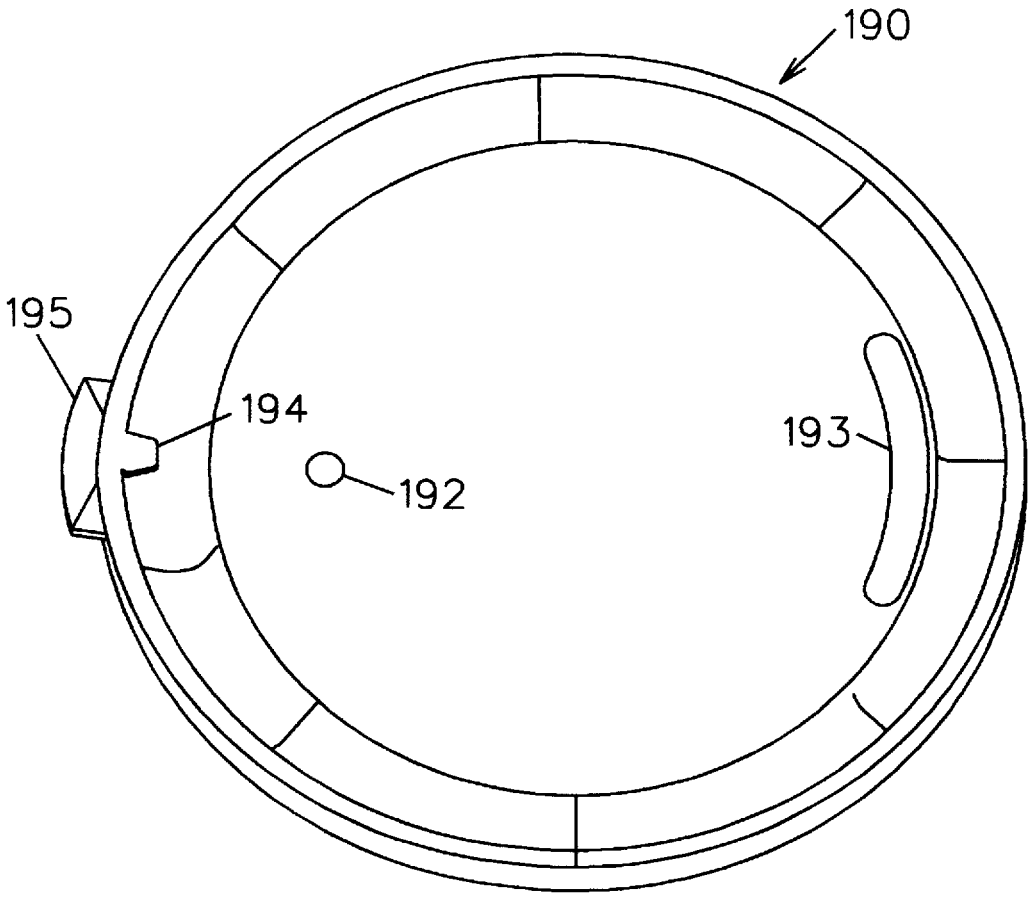
FIG. 8 is a bottom view of the cup lid on an enlarged scale.
Figure 9:
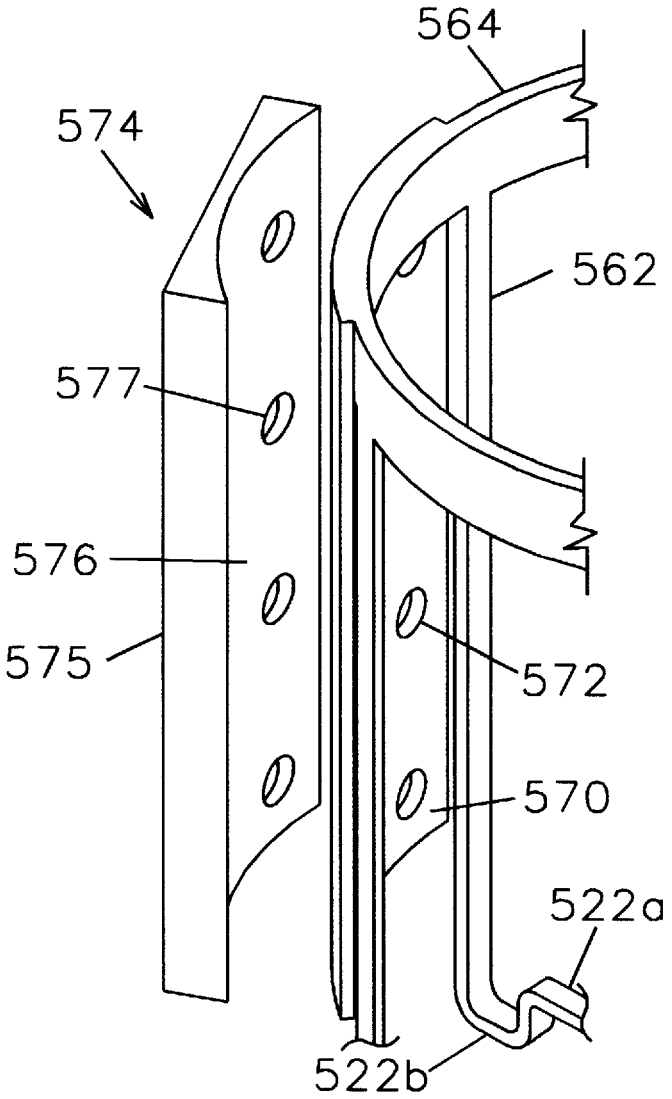
FIG. 9 is a fragmentary view of the cup holder showing a supplemental mounting plate prior to registration with the mounting plate of the cup holder.

At the top of the cup 100 is a lid 190. Lid 190 has an aperture 192 for insertion of a straw therein and an arc-like slot 193 serving as an outlet for the liquid within the cup. Underlying the rim of the lid 190 is an inwardly extending flange 194 (FIG. 8), the flange 194 designed to be positioned underneath the rim 182 of the cup when the lid 190 is secured to the cup. An opening 184 within the rim 182 allows for initial insertion of the flange 194 below the rim 182 upon placement of the lid 190 atop the cup rim 182. A flange 195 outwardly extends from the lid rim to indicate the position of flange 194. Alignment of the flange 195 with arrow 197 on cup indicates that flange 194 is aligned with slot 184 which allows for lid 190 removal. Rotation of flange 195 away from arrow 197 positions flange 194 underneath the cup rim 182.

The holder 500 further includes a mounting plate 570 extending between adjacent vertical ribs 562, the mounting plate 570 having a plurality of apertures 572 therein. Accordingly, fasteners may be inserted through the apertures 572 and into an adjacent support surface for attaching the holder 500 thereto.

A supplemental attachment plate 574 may also be used. The supplemental plate 574 has a flat surface 575 and an opposed, curved surface 576, the curvature of surface 576 conforming to the curvature of the mounting plate 570. The supplemental attachment plate 574 includes a plurality of apertures 577 which register with the apertures 572 found in the mounting plate 570. Accordingly, upon registration of the apertures 572, 577, fasteners may extend therethrough with the flat surface 575 of the optional attachment plate 574 enhancing attachment of the holder 500 to a flat, vertical surface or the like. It is understood that various forms of attachment may be used to attach the cup holder 500 to adjacent or underlying support surfaces.

Figure 7:
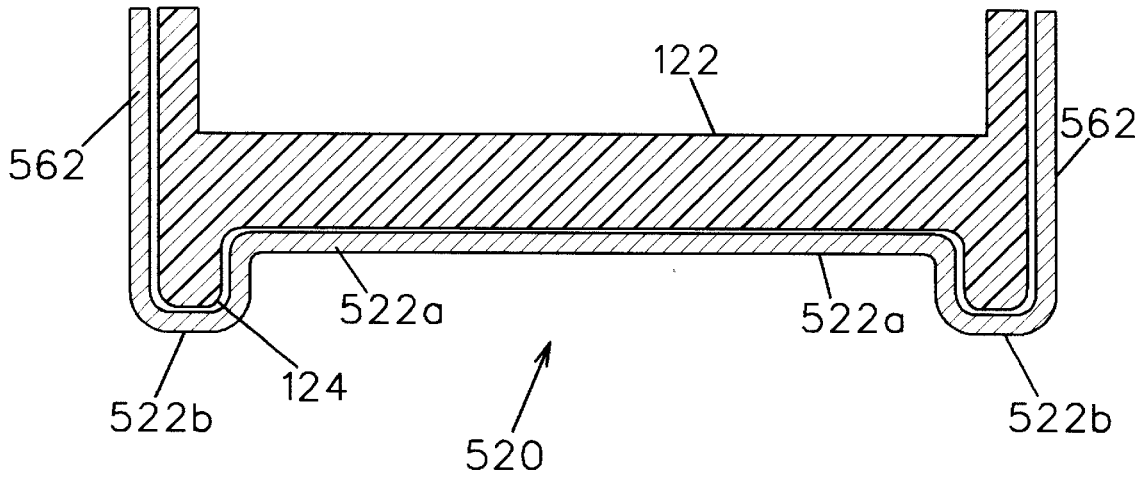
FIG. 7 is a partial, fragmentary sectional view of the base of the cup holder and cup on an enlarged scale.

In use upon attachment of the holder 500 to a desired surface, the cup 100 is filled with a liquid, the lid 190 then being locked to the rim 182 of the cup upon rotation of flange 195 away from arrow 197. The cup 100 may then be inserted into the holder 500 such that the depending annular flange 124 of the cup nests into the channel of the holder 500 as shown in FIG. 7. In such relationship the depending flange 124 is supported by at least the offset portion 522*a* of each rib. Also, the horizontal base 120 of the cup 100 is supported by the horizontal base of the holder as formed by the horizontal sections 522*a* of each rib 522.

Alternatively, if the particularly designed cup 100 is lost, misplaced or the like, a conventional cup can be used such that the horizontal support surface of the holder 500, as presented by rib portions 522*a*, supports the base of the conventional cup.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. A drinking cup system comprising:

a holder for receiving a cup therein, said holder comprising:

a base presenting a first surface;

a channel depending from said base and surrounding said first surface;

a sidewall upwardly extending from said channel and presenting an opening at a top end thereof;

a cup comprising:

a base;

a sidewall upwardly extending from said base and presenting an opening;

a handle extending from said cup sidewall and beyond said holder sidewall;

a flange depending from said base for releasable engagement with said channel, said cup supported by at least said channel; said holder base comprising a hub; a plurality of ribs radially extending from said hub for forming a part of said first surface; an offset at an end of each rib for forming a part of said channel; said first section of each rib lying in a common horizontal plane; said cup base comprising a horizontal surface for positioning above said first rib sections; said first rib sections alternatively support a second cup having a base, the base resting atop said first rib sections; said holder sidewall comprising a plurality of ribs upwardly extending from each offset at said rib end; a band connecting an upper end of each of said upwardly extending ribs; and an opening in said band for allowing said handle of said cup to be positioned between a pair of said upwardly extending ribs and to extend beyond said holder sidewall upon said cup being inserted in said holder.

2. A holder for a drinking cup comprising:

a base presenting a first support surface;

a channel depending from said base and surrounding said first support surface;

a sidewall upwardly extending from said channel and presenting an opening spaced from said base, said channel adapted to releasably engage a flange depending from a base of a drinking cup, whereby to support a cup nested within said holder; said base comprising a hub; a plurality of ribs radially extending from said hub for forming a part of said first surface; an offset at an end of each rib for forming a part of said channel; said first section of each rib lying in a common horizontal plane and adapted to support a second drinking cup presenting a surface for resting atop said first rib sections; said holder sidewall comprising a plurality of ribs upwardly extending from each offset at said rib end; a band connecting an upper end of each of said upwardly extending ribs; and an opening in said band for allowing said handle of said cup to extend beyond said holder sidewall upon said cup being inserted in said holder.

3. A drinking cup system comprising:

a holder for receiving a cup therein, said holder comprising:

a base presenting a first support surface;

a depending channel surrounding said first support surface;

a sidewall upwardly extending from said channel and presenting an opening spaced from said base;

a cup comprising:

a base;

a flange depending from said base for releasable engagement with said channel, said cup base supported by at least said channel;

means for attaching said holder to a support surface; said holder sidewall comprising a plurality of spaced-apart ribs vertically extending from said channel; a band connecting an upper end of each of said upwardly extending ribs; an opening in said band for allowing said handle of said cup to be positioned between a pair of said upwardly extending ribs and to extend beyond said holder sidewall upon said cup being inserted in said holder; and wherein said means for attaching comprises: a first plate extending between adjacent ribs of said plurality of ribs; at least one aperture for receiving a fastener therethrough, the fastener further attached to said support surface.

* * * * *